US005159948A

United States Patent [19]

Moreau et al.

[11] Patent Number: 5,159,948

[45] Date of Patent: Nov. 3, 1992

[54] TENT WITH FRAME FORMED BY HOOPS

[76] Inventors: Alain Moreau, 16 Rue Voltaire - 78100; Florent Baudin, 55 Rue Mareil - 78100, both of Saint Germain en Laye, France

[21] Appl. No.: 550,980

[22] Filed: Jul. 10, 1990

[30] Foreign Application Priority Data

Jul. 11, 1989 [FR] France ..... 89 08323

[51] Int. Cl.[5] ..... E04H 15/40

[52] U.S. Cl. ..... 135/104

[58] Field of Search ..... 135/104, 102, 103, 97

[56] References Cited

U.S. PATENT DOCUMENTS 3,474,802 10/1969 Loring .
3,751,862 8/1973 Linecker ..... 135/102
4,078,572 3/1978 Moss .

FOREIGN PATENT DOCUMENTS 8807891 1/1989 Fed. Rep. of Germany .
36730 1/1968 Finland ..... 135/102
2189594 1/1974 France .
2582339 11/1986 France .
474233 8/1969 Switzerland ..... 135/102

OTHER PUBLICATIONS

Pocket Camper article dated Oct. 1977.
Aerulande dated Apr. 1974.

*Primary Examiner*—Henry E. Raduazo
*Attorney, Agent, or Firm*—McAulay Fisher Nissen Goldberg & Kiel

[57] ABSTRACT

The present invention relates to a tent.

This tent is characterized in that it is formed by an elementary central tent (1) having a central frame symmetrical relative to a vertical axis, whose base constitutes a regular polygon with an even number of sides and which is formed by at least two identical diametrical hoops (9,11) whose lower ends take support on the ground, at the place of diametrically opposite summits of the base polygon, and which cross, at their centers, at the summit (16) of the central frame, on the vertical axis of symmetry (33'-read zz'), and of at least four vertical lateral hoops (15), and by at least two lateral tents (2,3,4) extending outward from lateral hoops of the central frame.

18 Claims, 1 Drawing Sheet

TENT WITH FRAME FORMED BY HOOPS

The present invention relates to a tent comprising a frame formed by hoops, the lower ends of which rest on the ground, and a canvas stretched over this frame.

Known are tents referred to as tunnel tents whose frame consists of parallel flexible hoops. Some of these tents, such as described in patent FR-A-2,189,594, have a structure formed by hoops articulated at their base on a frame and are made integral with the canvas which, having been stretched, alone keeps said hoops in the desired position. While such a structure offers the advantage of taking up little space, it has, on the other hand, neither much stability nor much resistance to wind.

Known also from Utility Model DE-U-8,807,891 are tents of the type whose frames are formed by crossed hoops which are curved at the time the tent is pitched and whose lower ends are connected together so that the hoop will, after being set up, keep its curved form. The hoops of the frame, which have the same or different dimensions, define the outward form of the tent. For the connection between the hoops—sheaths are provided on the outside of the canvas—this canvas, so that the connection will be outside of the canvas at the points where the hoops are to be placed—with sheaths into which the hoops are inserted and which ensure the suspension of the canvas on the hoops after the canvas is stretched.

The present invention relates to improvements made in this type of tent in order to substantially increase its uptake capacity and to divide it into different zones used for different purposes and communicating with one another.

To this effect a frame formed by hoops whose lower ends rest on the ground and a canvas stretched over this frame, and includes an elementary central tent having a central frame symmetrical to a vertical axis, the base of which constitutes a regular polygon with an even number of sides and which is formed by at least two identical diametrical hoops whose lower ends take support on the ground, at the place of diametrically opposite summits of the base polygon, and which cross, in their centers, at the summit of the central frame, on the vertical axis of symmetry, and at least four vertical lateral hoops, the two lower ends of each of these lateral hoops taking support on the ground respectively at the place of two adjacent summits of the base polygon, so that each lateral hoop is contained in a vertical plane passing through one side of the base polygon, and through at least two lateral tents extending outwardly from lateral hoops of the central frame.

The present invention thus permits forming a veritable network of associated tents, by sharing lateral hoops either with lateral hoops of identical tents or with hoops of "tunnel" type tents.

A form of execution of the present invention will be described below, as a non-limiting example, with reference to the annexed drawing in which.

Figure 1:
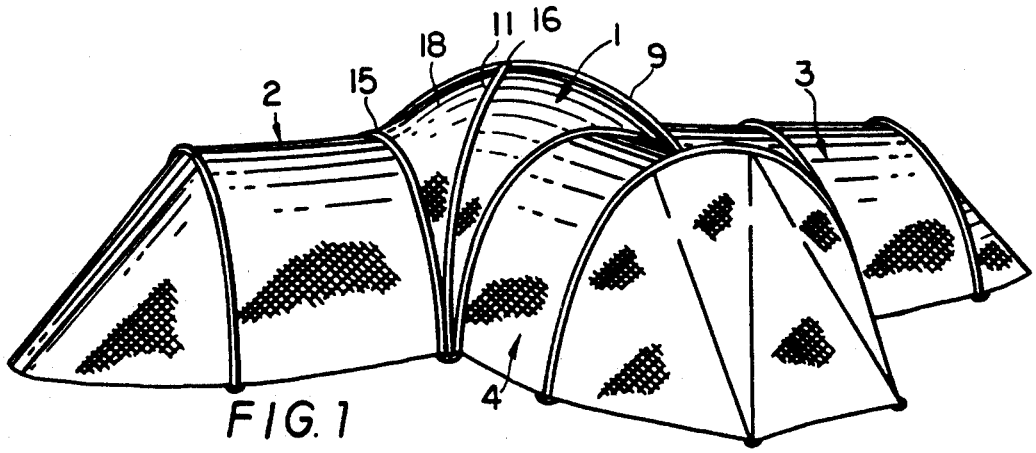
FIG. 1 is a view in perspective of a tent according to the invention.
Figure 2:
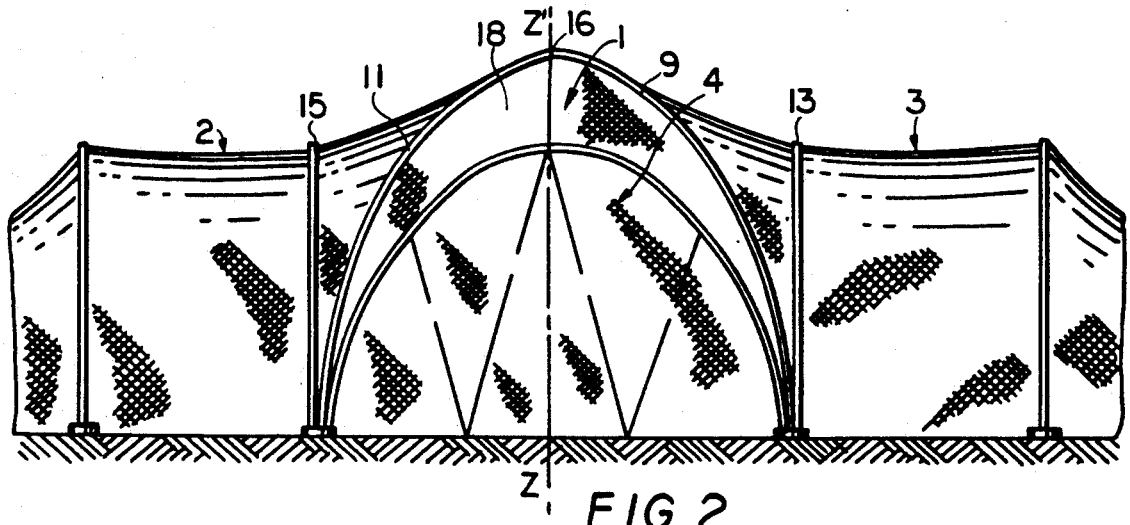
FIG. 2 is a partial view in elevation of the tent of FIG. 1, taken along the axis of the median lateral tunnel tent.
Figure 3:
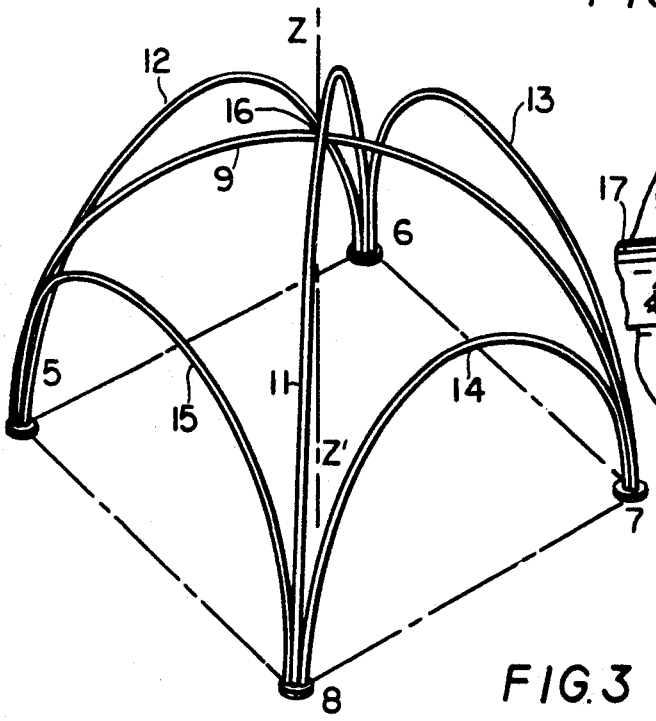
FIG. 3 is a view in perspective of the central frame of the tent.
Figure 4:
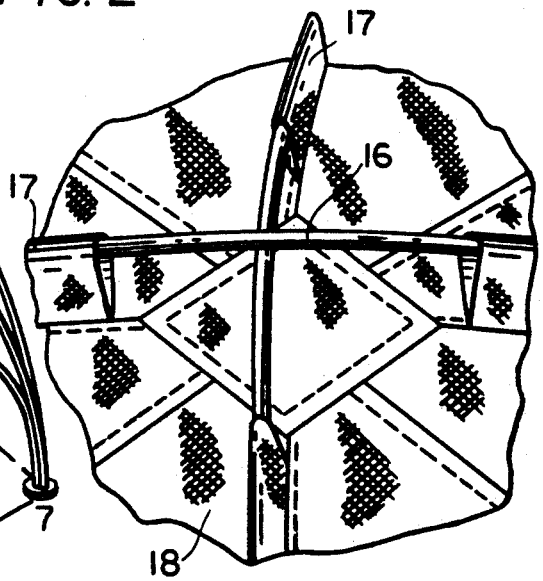
FIG. 4 is a view in perspective, on a larger scale, of the upper portion of the central tent.

In FIGS. 1 to 4 a tent according to the invention is represented which, in this particular non-limiting form of execution, consists of a central tent 1 to which are connected, for example, three lateral tents 2,3,4, two of the lateral tents 2,3 extend along a common axis, on either side of the central tent 1, the third lateral tent or median tent 4 extends on one side of the central tent 1, along an axis perpendicular to the common axis of the two lateral tents 2,3. These lateral tents may be of any known type with hoops and in the example described they are "tunnel" type tents.

The central tent 1 has a structure which is symmetrical relative to a vertical axis zz'. In this form of execution the central tent 1 has four sides and it presents consequently a fourfold symmetry around the vertical axis zz'. Its frame is formed by various hoops which take support on the ground, at their lower ends, at a place where summits 5,6,7,8 of the square which constitutes the base polygon of the central tent 1. This frame comprises two crossing diametrical vertical hoops 9 and 11, each of substantially like form and four lateral or side hoops 12,13,14,15 of like form whose lower ends are situated respectively at the place of the summits 5,6,7,8 of the base square. All hoops are formed from flexible rods which are arched so as to present the appropriate curvature at the time of pitching the tent, or by segments of tubular hoops nested in one another.

The diametrical hoop 9 extends in a vertical plane passing through the opposite summits 5 and 7 of the base square, that is, through one of the diagonals of the square, while the other diametrical hoop 11 passes through the opposite summits 6 and 8 of the base square and hence contains the other diagonal of the square. These hoops cross at the summit 16 of the tent, passing one over the other, and they are engaged in sheaths 17 integral with the canvas 18 of the central tent 1, above the latter as shown in greater detail in FIG. 4, so that the canvas 18 of the central tent 1 hangs from the sheaths 17.

The four lateral hoops 12,13,14,15 extend in vertical planes passing respectively through the four sides of the base square. Owing to this the two lower ends of the lateral hoop 12 are situated at the summits 5 and 6 of the base square, the two lower ends of the lateral hoop 13 are situated at the summits 6 and 7 of this square, the two lower ends of the lateral hoop 14 are situated at the summits 7 and 8, and the two lower ends of the lateral hoop 15 are situated at the two summits 8 and 5.

The canvases of the lateral tents 2,3,4 are connected to the central tent 1 at the place of the lateral hoops 12,13,14,15 which thus serve as starting points of these tents. In the non-limiting form of execution shown, the lateral tunnel tent 2 connects at hoop 15, the opposite lateral tunnel tent 3 connects at hoop 13, and the median tunnel tent 4 connects at hoop 14.

Thus, from the above description it is seen that, when the tent is pitched, the tent according to the invention comprises several distinct zones which communicate with one another and which are able to serve different purposes. The central tent 1 can, for example, constitute a meeting or catering zone, while the lateral tents 2,3,4 can form sleeping quarters.

It is possible to conceive numerous variants of execution of the tent that has been described. For example the central tent 1 may have any twofold symmetry and its base may be formed, for example, by a regular hexagon, a regular octogon, etc.

It is also possible to connect the lateral tents, such as tents 2,3,4, to other tents of the same type or to other tents of the type of the central tent 1. Thus a meshed network can be obtained, the nodes of which are formed by the central tents 1 and the connection elements are formed by the lateral tents. One can also join several central tents 1 and connect them along their lateral hoops, so as to increase the size of the central zone of the tent.

Also there may be connected to one or several of the lateral hoops of the central tent a single canvas extending to the ground and forming an apse.

In an interesting variant of the invention, the base common to three hoops is held by a connecting element which is disposed along each of the sides of the regular polygon constituting the base of the rigid or flexible frame. This connecting element on the one hand performs the role of holding the hoops preventing them from moving away from each other and, on the other hand, it performs the role of reinforcement of the structure.

The connecting elements may consist of straps, each of the ends of which is provided with two holes respectively intended to receive one end of a diametrical hoop, and one end of a lateral hoop.

The connecting elements can of course also be disposed along the vertical of the diametrical hoops, and to do this each of the straps would then be provided, at each of its ends, with three holes intended to receive the respective ends of two lateral hoops and of the diametrical hoop.

The straps may also serve to ensure the fixation of the tent canvas on the diametrical and lateral hoops. For this, each of the straps is provided, near one end of a lateral hoop, with an attachment hole intended to receive a tie integral with the canvas of the tent.

We claim:

1. A tent having a central summit and formed of a stretched main canvas, comprising:

a base for a central tent having a polygonal shape with an even number of sides, and corners of said base including support means;

at least two identical continuous flexible diametrical hoops each having a pair of free ends for support by said corners of said base at diametrically opposite corners thereof by said support means, said two identical hoops at said central summit thereof defining with said base a central frame for said central tent, a center point of said base together with said central summit defining a central vertical axis of symmetry for said central tent passing through said center point and said summit;

at least four lateral vertical hoops, one for each side of said base, each having a pair of free ends and supported by said support means on a side joining two of said adjacent support means for positioning each of said lateral vertical hoops in a plane substantially parallel to said central vertical axis and substantially perpendicular to said base and passing through one of said sides of said polygon;

at least two lateral tents of the tunnel type connected with said central tent, each of said lateral tents being connected with one of said sides of said polygon and one of said lateral vertical hoops;

said canvas being stitched over said four lateral vertical hoops to form said central tent; and means external of said central tent and connected therewith for supporting said canvas from said two identical continuous diametrical hoops.

2. The tent according to claim 1, wherein said diametrical hoops cross at said summit and pass one over the other.

3. The tent according to claim 1, wherein said supporting means includes sheaths, and said diametrical hoops pass in said sheaths, said sheaths being integral with said canvas of said central tent and extend over it, so that the canvas of said central tent hangs on said sheaths on said diametrical hoops.

4. The tent according to claim 1, wherein said lateral tents also include said stretched canvas, and said stretched canvas connects with said lateral hoops of said central tent, said lateral hoops serving as a starting point of said lateral tents.

5. The tent according to claim 1, including connecting elements connecting at least one common end of two of said vertical hoops to at least one other common end of one of said two diametrical hoops.

6. The tent according to claim 5, wherein each of said connecting elements is disposed substantially in the vertical line of a lateral hoop.

7. The tent according to claim 5, wherein each of the connecting elements is disposed substantially in a vertical line of a diametrical hoop.

8. The tent according to claim 1, including base summits at the corners of said polygon, and said base summits including means for receiving said free ends of said hoops for holding thereof to said base polygon.

9. The tent according to claim 1, wherein the polygon is a regular polygon.

10. The tent according to claim 3, wherein said lateral tents also include a stretched auxiliary canvas, and said auxiliary stretched canvas connects with said canvas of said central tent at said lateral hoops of said central tent, said lateral hoops serving as a starting point of said lateral tents.

11. The tent according to claim 2, including connecting elements at the covers of said base connecting at least one common end of two of said vertical hoops to at least one other common end of one of said diametrical hoops.

12. The tent according to claim 3, including connecting elements connecting at least one common end of two of said vertical hoops to at least one other common end of two hoops.

13. The tent according to claim 4, including connecting elements connecting at least one common end of two of said vertical hoops to at least one other common end of two hoops.

14. The tent according to claim 1, including three lateral tents, two of said lateral tents extending on a side of said central tent opposite to each other and extending on one side of said central tent along an axis forming a common axis of said two lateral tents, and said third tent extending along an axis substantially perpendicular to said common axis.

15. The tent according to claim 1, wherein said base has orthogonally related sides, and one of said lateral tents extends along an axis perpendicular to a common axis of said two other lateral tents.

16. The tent according to claim 1, wherein opposite sides are formed by said lateral hoops.

17. The tent according to claim 16, wherein said lateral tents share a side with said main tent formed by said lateral hoops.

18. The tent according to claim 1, wherein the polygon is a square.

* * * * *